United States Patent [19]

Shallenberg et al.

[11] 4,174,977

[45] Nov. 20, 1979

[54] APPARATUS AND METHOD FOR MOPPING FLOORS

[75] Inventors: Robert L. Shallenberg, Wheaton; Austen B. Hufton, West Chicago; Roland A. Blomgren, Glen Ellyn; William M. Copeland, Hoffman Estates, all of Ill.

[73] Assignee: ServiceMaster Industries, Inc., Downers Grove, Ill.

[21] Appl. No.: 885,859

[22] Filed: Mar. 13, 1978

[51] Int. Cl.[2] ..... A47L 13/22; B08B 7/04

[52] U.S. Cl. ..... 134/6; 134/29; 222/452

[58] Field of Search ..... 134/6, 29; 73/223; 222/450, 424.5, 519, 452, 444; 401/270, 280, 281

[56] References Cited

U.S. PATENT DOCUMENTS

| | | | |
|---|---|---|---|
| 455,043 | 6/1891 | Henninger et al. | 222/444 X |
| 1,167,315 | 1/1916 | Reding | 401/270 X |
| 2,059,135 | 10/1936 | Moe | 222/452 |

FOREIGN PATENT DOCUMENTS

| | | |
|---|---|---|
| 298589 | 10/1928 | United Kingdom. |
| 307402 | 1/1930 | United Kingdom. |
| 345128 | 3/1931 | United Kingdom. |
| 358804 | 10/1931 | United Kingdom. |
| 420674 | 12/1934 | United Kingdom. |
| 825357 | 12/1959 | United Kingdom. |
| 974177 | 11/1964 | United Kingdom. |
| 1237916 | 7/1971 | United Kingdom. |
| 1344459 | 1/1974 | United Kingdom. |

*Primary Examiner*—Richard V. Fisher

*Attorney, Agent, or Firm*—Allegretti, Newitt, Witcoff & McAndrews

[57] ABSTRACT

Apparatus and a method for rinsing and sanitizing a mop utilized to clean floors. Utilized with a conventional mop, mop wringer and mop bucket, the apparatus dispenses a pre-selected volume of cleaning solution onto the mop. The mop is then wrung dry and used, and the method of rinsing and sanitizing is repeated.

11 Claims, 12 Drawing Figures

APPARATUS AND METHOD FOR MOPPING FLOORS

BACKGROUND OF THE INVENTION

This invention relates to the cleaning of floors and more particularly, to an improved apparatus and a method for rinsing and sanitizing a mop utilized to clean floors and other surfaces.

The critical importance of maintaining institutions, such as hospitals, nursing homes and the like, as clean as possible has long been recognized. An important aspect of cleaning such institutions is the cleaning of the floors so as to assure that bacteria thereon are killed and are not permitted to spread infections among the patients.

In the past, the equipment typically used for cleaning floors has consisted of a mop, a mop bucket and a mop wringer mounted on the bucket. Conventionally, during normal usage, the mop bucket is initially filled with "fresh" cleaning solution. The mop is placed in the bucket to be soaked with cleaning solution, is wrung partially dry in the wringer so that the excess or expelled solution in the mop is returned to the bucket, and is then used to mop an area of the floor, e.g., a patient's room. The "dirty" mop is then replaced in the bucket, is resoaked with cleaning solution and is again wrung partially dry in the bucket mounted wringer. This soaking, wringing and using cycle must be periodically interrupted to empty the "dirty" solution in the bucket and to add "fresh" cleaning solution to the bucket.

This conventional method of rinsing a mop used for mopping floors has a number of drawbacks or problems from the standpoint of the efficient, sanitary cleaning of the floors. First, after a floor area has been mopped, the mop is returned to the bucket where bacteria picked up by the mop from the floor may contaminate the cleaning solution in the bucket. Since the cleaning solution in the mop bucket is carried on the wet mop to each successive floor area to be cleaned, the risk of spreading bacteria, and thus infection, increases with each return of the mop to the mop bucket. Second, since the cleaning solution must be changed frequently, a substantial portion of a worker's time must be expended changing the cleaning solution, rather than mopping. Third, absent continuous supervision, supervisory personnel cannot be assured that the cleaning solution will be properly prepared and changed with the appropriate frequency. If it is not, the risk of spreading bacteria, and thus infection, is greatly magnified.

In recognition of the problem of unsanitary conditions caused by a worker using the conventional equipment and method of rinsing a mop, state and Federal regulatory agencies have been recommending, and sometimes requiring, the usage of two mop buckets in an attempt to solve this sanitation problem. Under these recommendations and requirements, one of the buckets contains "fresh" cleaning solution and the other is used for the "dirty" or contaminated cleaning solution. However, even when these recommendations and requirement are followed, sanitation is not greatly improved. This is because after the "dirty" solution has been returned or wrung into the other bucket, the mop must then be dripped into the "clean" solution in the one bucket. Thus any bacteria picked up by the mop during cleaning will, as a practical matter, contaminate the "fresh" cleaning solution in the other bucket. In addition, the use of two buckets greatly increases the nonproductive time required to empty and re-fill the buckets. And because as a general rule the workers who are doing the mopping are unskilled, proper use of the two mop buckets and the required frequent changing of the "fresh" and "dirty" solutions is even less assured with two mop buckets than with one. Hence this suggested solution to the sanitation problem is not considered satisfactory.

SUMMARY OF THE INVENTION

It is thus a principal object of the present invention to provide an improved apparatus and method of rewetting a mop for assuring improved sanitation in the mopping of floors in institutions such as hospitals, nursing homes and the like.

Another object of the present invention is to provide an improved apparatus for and method of rewetting a mop that separates "fresh" cleaning solution from "dirty" or contaminated cleaning solution.

Still another object of the present invention is to provide an improved apparatus and method of rewetting a mop that effectively eliminates the need for emptying "dirty" or contaminated solution and renewing the supply of "clean" solution within the span of a normal work schedule.

A further object is to provide an improved apparatus and method of rewetting a mop that can be used without constant supervision and with satisfactory assurance that "fresh" cleaning solution will be used with each return of the mop to the floor to be mopped.

Thus in a principal aspect, the present invention is directed to an improved apparatus for repeatedly dispensing a pre-selected volume of "fresh" cleaning solution into a mop to rinse and sanitize a mop. This improved apparatus is novel and may be utilized with a conventional mop bucket having a mop wringer mounted thereon. More particularly this apparatus comprises: a reservoir tank that defines a reservoir to hold multiple pre-slected volumes of "fresh" cleaning solution; a metering tank that defines a metering chamber to hold a single, pre-selected volume of the "fresh" cleaning solution to be dispensed; a dispensing spout for dispensing the "fresh" cleaning solution onto the mop; and valve means that defines a first port, a second port and a third port, with the reservoir being connected to the first port, the metering chamber being connected to the second port, and the dispensing spout being connected to the third port. The valve means has a filling mode and a dispensing mode and is operable: (1) for connecting the first port to the second port in the filling mode so that the metering chamber is filled with "fresh" cleaning solution from the reservoir; and (2) for connecting the second port to the third port and disconnecting the second port from the first port in the dispensing mode so that the pre-selected volume of "fresh" cleaning solution in the metering chamber may flow through the dispensing spout onto the mop.

In another aspect, the present invention is an improved method for rinsing and sanitizing a mop that is to be utilized to clean floors or other surfaces. This improved method utilizes a conventional mop bucket having a mop wringer and comprises the steps of: (1) placing the mop in the bucket to rinse away large dirt particles, after a surface has been cleaned; (2) placing the mop in the mop wringer; (3) wringing the "dirty" or contaminated cleaning solution from the mop into the mop bucket with the mop wringer; (4) dispensing a preselected volume of "fresh" cleaning solution onto the mop; and (5) wringing a portion of this "fresh" cleaning solution into the mop bucket with the mop wringer so that the mop is partially dry for use in cleaning a new floor area. Alternatively, the improved method can comprise the steps of: (1) placing the mop directly into the mop wringer; (2) dispensing a first pre-selected volume of "fresh" cleaning solution onto the mop; (3) wringing the mop "dry" with the mop wringer so that substantially all of the "dirty" and "fresh" solution in the mop passes into the mop bucket; (4) dispensing a second pre-selected volume of "fresh" cleaning solution onto the mop; and (5) wringing a portion of this other "fresh" cleaning solution into the mop bucket with the mop wringer so that the mop is partially dry for use in cleaning a new surface area. According to this improved method, the mop is always kept out of contact with the source of "fresh" cleaning solution since "fresh" solution is always dispensed directly onto the mop and is wrung out of the mop by the mop wringer without the mop being in contact with "dirty" or contaminated solution.

With the improved apparatus and method of the present invention, the foregoing objects are satisfied; and labor, materials and energy may be saved because of the following unexpected results.

First, it was discovered that a pre-selected volume of only about fourteen to twenty-one fluid ounces of "fresh" cleaning solution need be dispensed onto a wrung-dry mop at the time to "soak", or to rinse and sanitize, the mop. Also, this volume decreases with the age of the mop. When fourteen ounces are dispensed onto a mop using the improved apparatus of the present invention, about six ounces can be wrung from the mop into the bucket to leave the mop damp for mopping. Of the eight ounces remaining in the mop, four ounces will stay on the floor as a result of the mopping and the remainder will be wrung out of the mop into the mop bucket. Assuming that cleaning solution is dispensed onto the mop twenty cycles during a work schedule, this means that only two hundred eighty ounces (slightly over two gallons) of "fresh" cleaning solution will be needed for a work schedule, as compared with approximately ten gallons of cleaning solution required by the use of the conventional equipment and methods. Futher, only two hundred ounces ($20\times6$ ounces$+20\times4$ ounces) of "dirty" cleaning solusion will be wrung from the mop each day, and thus the mop bucket need be emptied only at the end of the work schedule, rather than many times throughout the schedule. Thus, cleaning solution is conserved, only one conventional mop bucket is needed, and the time otherwise taken to change cleaning solution can be used efficiently on actual mopping or on other work.

In relation to the use of two mop buckets, the improved apparatus of the present invention also saves the time of soaking the mop twice every time it is returned to the buckets, and the time of wringing the mop a second time on each return to the buckets. And in addition, the mop is never brought into contact with the source of "fresh" cleaning solution so that there is no danger of contaminating this source.

It was also discovered that the cleaning solution need not be injected into the mop under pressure, but is quite effective when permitted to run over the mop. Using a dispensing spout having a narrow cross-section, the present invention dispenses the cleaning solution at a controlled rate, by gravity, into the mop. This advantage, plus many others, will become apparent from the following description of the preferred embodiment:

BRIEF DESCRIPTION OF THE DRAWINGS

The preferred embodiments of the present invention will next be described, with reference to the accompanying drawings, wherein.

DESCRIPTION OF THE PREFERRED EMBODIMENTS

Figure 1:
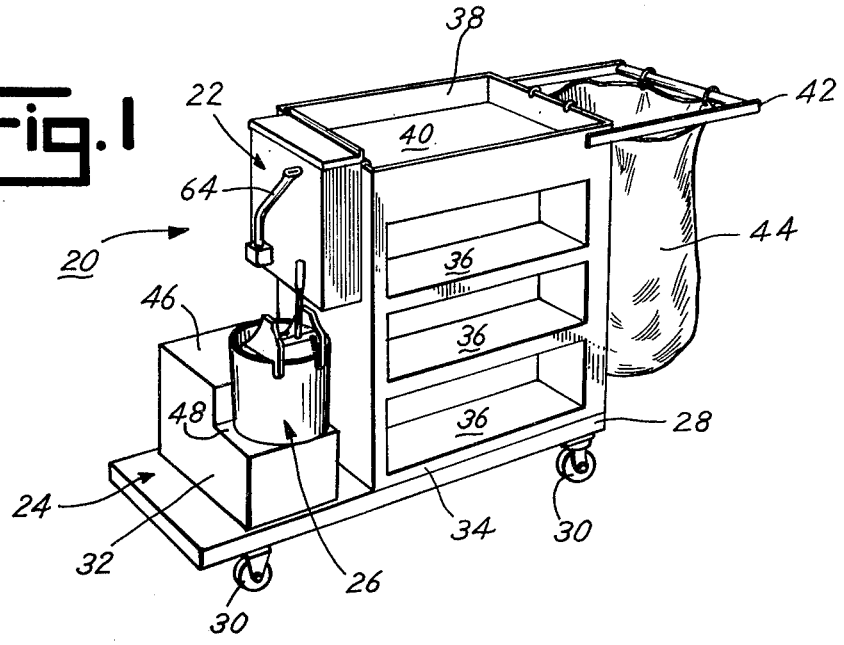
FIG. 1 is a perspective view of a cleaning cart incorporating one embodiment of the present invention.

Referring to FIG. 1, an embodiment 20 of the present invention includes a dispensing unit 22 that is adapted to be mounted on a conventional cleaning cart 24 above a conventional mop bucket 26.

For the purposes of illustration only, the cleaning cart 24 includes a flat, horizontal base 28. Pivotable wheels 30 are attached to the corners of the cart 24 to facilitate movement of the cart 24 by a worker. Mounted atop the base 28 is a tool and supply stand 34 and a mop bucket stand 32.

The tool and supply stand 34 is generally rectangular and adapted to hold cleaning supplies and tools (not shown). A plurality of recessed shelves 36 are defined on either side of the tool and supply stand 34, and an upwardly extending lip 38 about the top of the tool and supply stand 34 defines a tray 40 for often used items. Hung from a U-shaped bracket 42 that extends horizontally off the back of the tool and supply stand 34 is a bag 44 for trash or refuse. The bracket 42 doubles as a handle for pushing the cleaning cart 24, and the bag 44 is removably mounted on the bracket 42 for ease in dumping refuse.

The mop bucket stand 32 extends across the width of the base 28 and defines two raised, stepped platforms 46 and 48. The upper platform 46 may be used as desired, and the lower platform 48 is for supporting the mop bucket 26.

Figure 2:
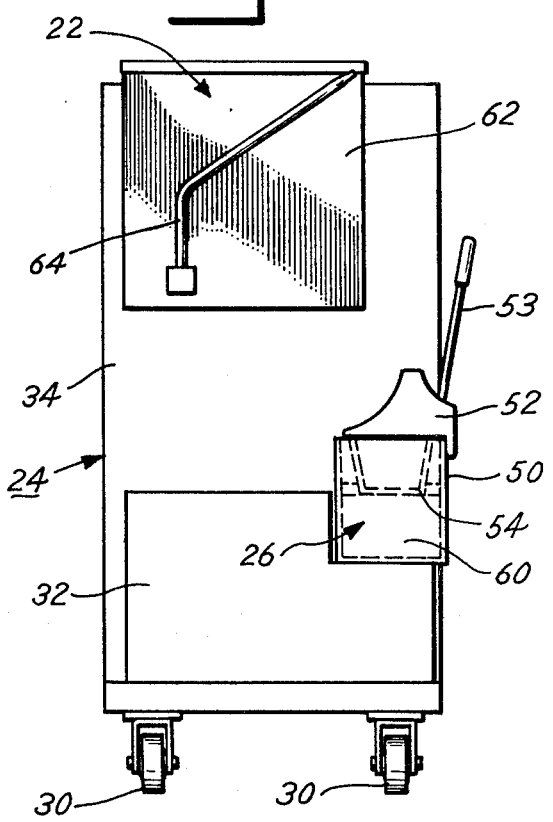
FIG. 2 is an end view of the cleaning cart of FIG. 1, depicting the dispensing spount of the embodiment of FIG. 1 in a non-dispensing position.
Figure 3:
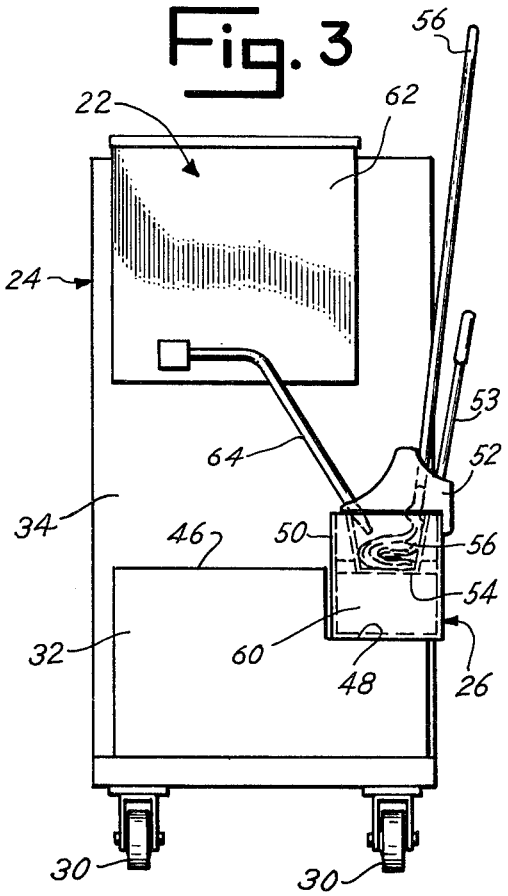
FIG. 3 is an end view similar to FIG 4, depicting the dispensing spout in a dispensing position to dispense "fresh" cleaning solution onto a mop.

As shown in FIGS. 1-3, the mop bucket 26 is of conventional design and construction. Hung on the cylindrical side wall 50 of the mop bucket 26 is a conventional, manually operated mop wringer 52 having a basket 54 that extends into the mop bucket 26, and a handle 53 that is used to actuate the wringer 52 in the normal manner. Below the basket 54, the mop bucket 26 defines a well 60 for receiving the "dirty" or waste solution wrung from the mop 56. The "dirty" or waste solution that has been wrung from the mop 56 into the well 60 cannot, during normal usage, again come in contact with the mop 56 when the mop 56 is disposed in the basket 54.

Figure 4:
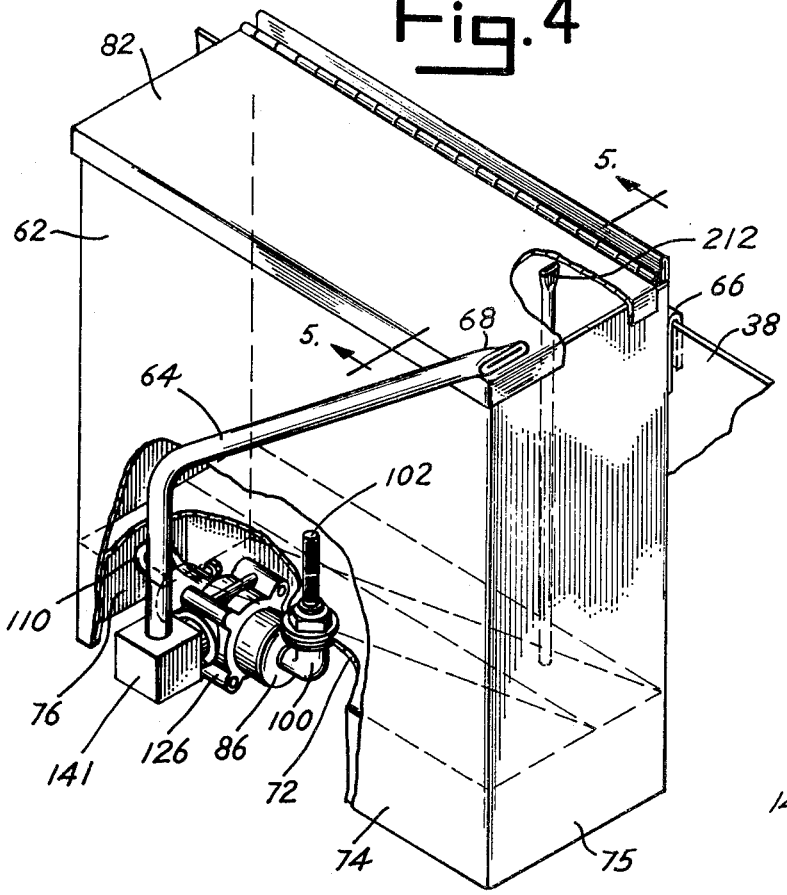
FIG. 4 is a perspective view of the reservoir tank to the embodiment of FIG. 1 broken away to show a first alternative valve.

Turning now to the dispensing unit 22, a generally rectangular housing 62 has a first alternative dispensing spout 64, shown best in FIG. 4, pivotably mounted thereon for pivotal or rotational movement about a substantially horizontal axis. The housing 62 is removably hung from the upper lip or edge 38 of the tool and supply stand 34 by a hanger 66 shown best in FIG. 4. When hung, the housing 62 is above and horizontally offset from the mop bucket 26. The dispensing spout 64 is thus above the mop bucket 26 and horizontally offset therefrom in a direction transverse to its axis of pivotal movement.

As shown by comparing FIGS. 2 and 3, the dispensing spout 64 is pivotable between an upright or non-dispensing position and a lowered or dispensing position. The dispensing spout 64 is pivoted manually. In the dispensing position, the free end or tip 68 of dispensing spout 64 extends adjacent to and above the basket 54 and above the mop 56 disposed therein. The dispensing spout 64 is hollow throughout its length and is adapted to be repeatedly pivoted between its non-dispensing and dispensing positions.

As will be hereinafter described in detail, the housing 62 contains "fresh" cleaning solution (e.g. a solution of water and a pre-selected cleaning chemical), and includes metering means for the solution, so as to assure that a pre-selected volume of "fresh" cleaning solution is dispensed onto the mop 56 with each pivotal movement of the dispensing spout 64 from its non-dispensing position to its dispensing position.

Referring now to FIGS. 4–7, the housing 62 has a raised bottom 72 sealed to walls 74–77 thereof against fluid leakage. The bottom 72 and the walls 74–77 form a reservoir tank 78 that defines a reservoir 80. The size of the housing 62 is selected so that the reservoir 80 holds a supply of "fresh" cleaning solution equal to a plurality of the pre-selected volumes to be dispensed onto the mop 56. To provide for ease in replenishing the supply of cleaning solution, the upper end of the reservoir tank 78 has a cover 82 hingedly attached to the wall 76 of housing 62 above the hanger 66.

Figure 5:
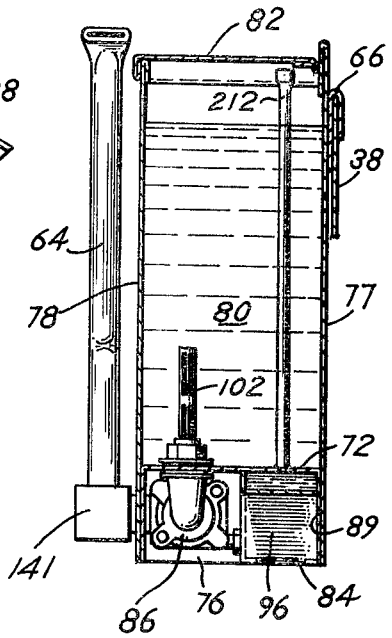
FIG. 5 is an end view of the reservoir tank of FIG. 4.

Located generally below the raised bottom 72 within the housing 62 is the metering means referred to above. As best shown in FIG. 5, this metering means includes a metering tank 84 and a first alternative valve 86.

Figure 6:
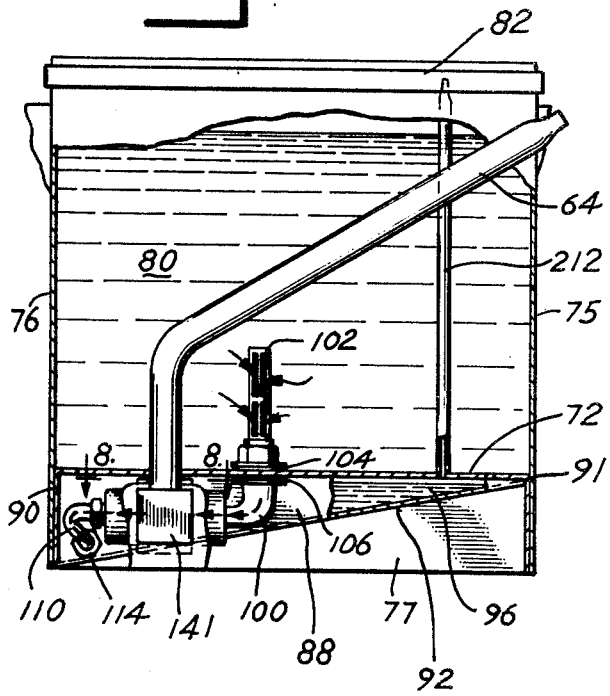
FIG. 6 is a side view of the reservoir tank of FIG. 4, depicting the dispensing spout in the nondispensing position of FIG. 2.
Figure 7:
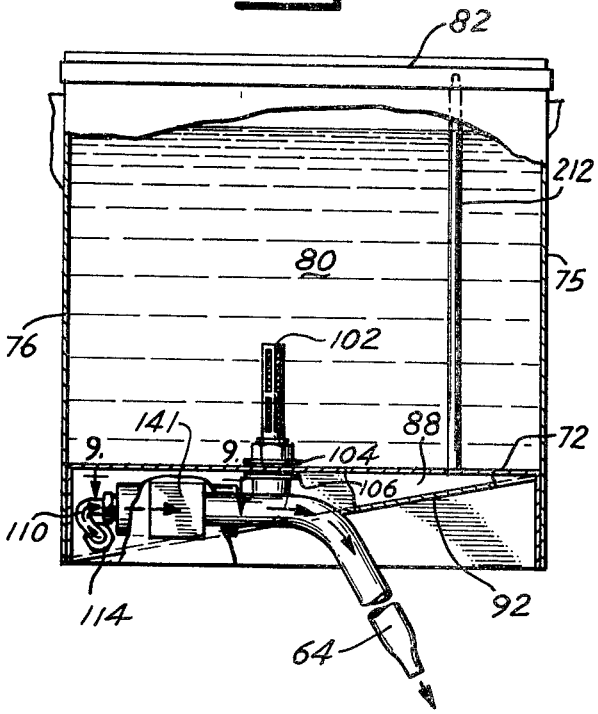
FIG. 7 is a side view of the reservoir tank of FIG. 4, depicting the dispensing spout in the dispensing position of FIG. 3.

As shown in FIG. 6, the metering tank 84 lies under the raised bottom 72 of the reservoir tank 78 and extends across the width and across approximately half the breadth of the housing 62. The metering tank 84 includes four side walls 88–91 sealed to a bottom 92 against fluid leakage. The raised bottom 72 of the reservoir tank 78 serves as the top of the metering tank 84. The side walls 88 and 89, which extends across the width of the housing 62, have the shape of a right triangle with its right angle between an upper horizontal side and a vertical side. The bottom edge of each side 88 and 89 thus forms the hypotenuse of a triangle, and the bottom 92 slants downward from right to left as viewed in FIGS. 6 and 7.

A metering chamber 96 having a substantially triangular cross-section is thus defined by the metering tank 84. The chamber 96 is sized to hold a single preselected volume of cleaning solution, preferably fourteen ounces, and a valve 86 operates to alternately fill the metering tank 84 from the reservoir tank 78 and then empty the metering tank 84 through the dispensing spout 64.

More specifically, the valve 86 defines a first port that connects to or communicates with the reservoir 80, a second port that communicates with the chamber 96 and a third port that communicates with a relatively small diameter plastic tube 210 (see FIG. 9) that is disposed within and extends from one end to the other of the dispensing spout 64. In a filling mode, the valve 86 opens the first port to the second port to fill the chamber 96 from the reservoir 80, and in a dispensing mode, the valve 86 closes the first port and opens the second port to the third port thereby dispensing the contents of the chamber 96 through the third port. A vent 212 opens the chamber 96 to the atmosphere above the reservoir 80, and the force of gravity fills and empties the chamber 96. Thus only a single, pre-selected volume of "fresh" cleaning solution is dispensed onto the mop 56 each time the spout 64 is moved from its non-dispensing position to its dispensing position, and trapped air does not affect the dispensing action.

Referring again to FIGS. 4–7, the valve 86 is connected to the reservoir tank 78 by a first pipe 100. A hole is drilled in the bottom 72 of the housing 62 and an upright fluid filter 102 is placed therein. Gaskets 104 and 106 secured on the upper surface and the lower surface, respectively, of the bottom 72 about the filter 102 prevent leakage from the reservoir 80. The first pipe 100 connects to a fitting (not shown) on the fluid filter 102 below the bottom 72 and to a fitting 108, shown in FIG. 8, that is screwed onto the valve 86.

Opposite the first pipe 100, a second pipe or tube 110 attached to a fitting 112 joins the valve 86 to the metering tank 84. As shown best in FIG. 6, the second pipe 110 is connected to a fitting 114 that is placed in a hole drilled in the side wall 88 of the metering tank 84 at or near its bottom corner 92.

Figure 8:
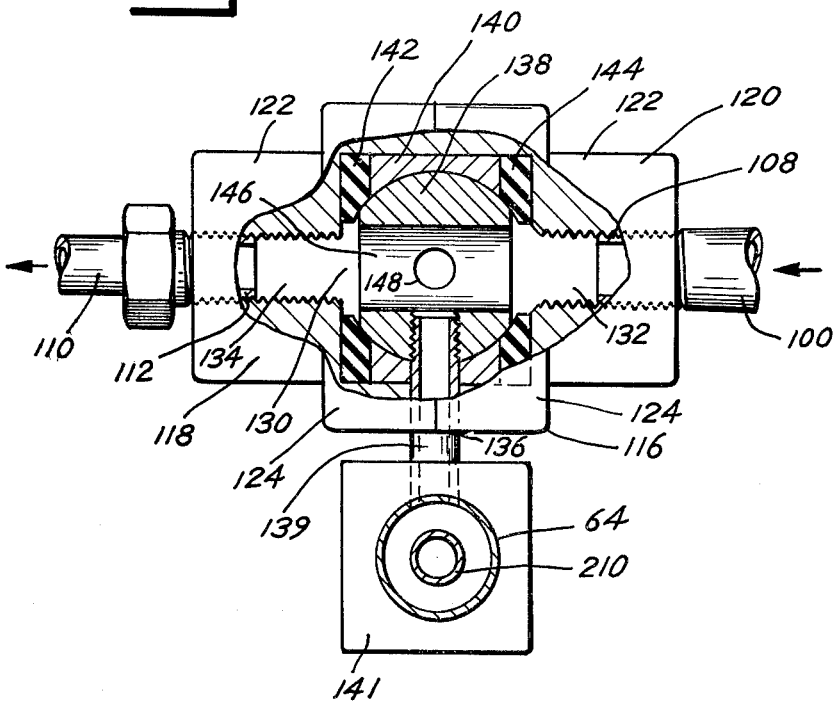
FIG. 8 is a partially cross-sectioned top view of the first alternative valve, taken along line 8—8 of FIG. 6.
Figure 9:
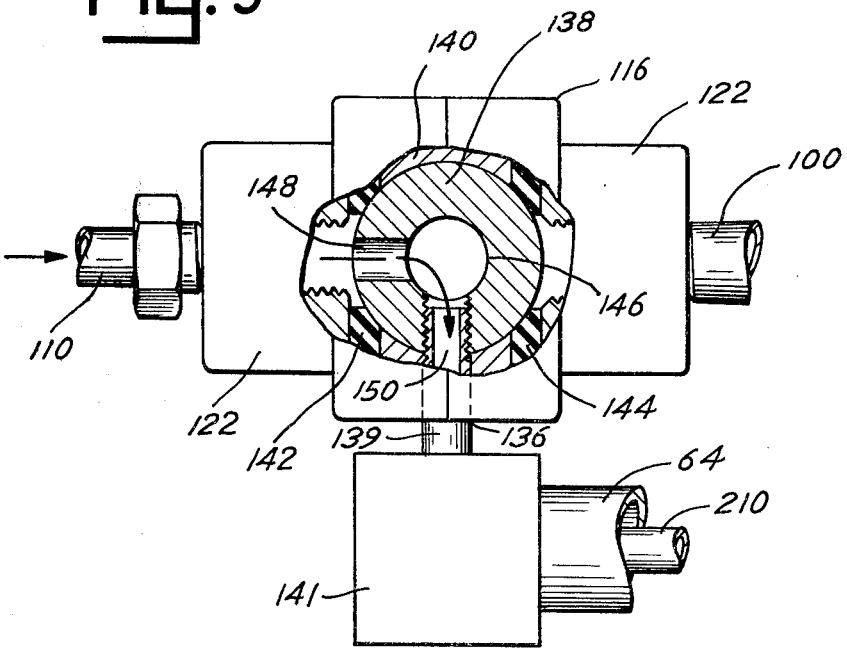
FIG. 9 is a view similar to FIG. 8, taken along line 9—9 of FIG. 7.

The first alternative valve 86 is shown in detail in FIGS. 8 and 9. Referring first to FIG. 8, the valve 86 is in the filling mode when the dispensing spout 64 is in the non-dispensing position of FIG. 1. Referring to FIG. 9, valve 86 is in the dispensing mode when the dispensing spout 64 is in the dispensing position of FIG. 3. The dispensing spout 64 is rigidly connected to a valve member 138 of the valve 86, and pivotal movement of the dispensing spout 64 thus pivots the valve member 138.

The valve 86 includes a valve body 116 that has two sections 118 and 120. Each of the sections 118 and 120 have a generally cylindrical portion 122 with a central axis, and an enlarged, axially aligned cylindrical portion 124. Circumferentially spaced bosses 126, shown in FIG. 4, are formed on the portions 124 and the sections 118 and 120 are joined by bolts and nuts which fit holes drilled through the bosses 126. When joined, the axes of the sections 118 and 120 are aligned, and the transversely extending faces of the portions 124 are placed in juxtaposition. As oriented in FIG. 8, the section 118 is to the left, the section 120 is to the right, and the common axis of the sections 118 and 120 extends across FIG. 8 from right to left.

Defined within the portions 124 is an axially aligned cylindrical valve chamber 130. A first axially aligned opening 132 defined in the section 120 opens into the chamber 130 as a "first port", as does a second axially aligned opening 134 defined in the section 118, as a "second port". A third opening 136, which is defined in the faces 128 of the sections 118 and 120, extends transversely into the valve chamber 130 as a "third port". Each of the openings 132, 134 and 136 is circular in cross-section, and the openings 132 and 134 each have threads traced therein for receiving the tubular fittings 108 and 112, respectively. A tubular fitting 139 is received within the opening 136 and one end thereof is threaded into a passageway or hole 150 drilled in the valve member 138 as hereinafter described. The other end of the fitting 139 is connected with a block 141 which receives and supports the adjacent end of the spout 64 and which provides a means for fluid to flow from the fitting 139 to and through the tube 210.

Contained within the valve chamber 130 is the valve member 138, which is spherical. A split, generally annular bearing 140 encircles and supports the valve member 138, and two generally annular seals 142 and 144 made of rubber or the like are positioned on opposite ends of the bearing 140 to prevent fluid flow around the valve member 138.

Supported by the bearing 140, the valve member 138 is pivotable about a central axis between the positions shown in FIGS. 8 and 9 as a result of movement of the spout 64 acting through the block 141 and the fitting 139. In the position shown in FIG. 8, a first passageway or hole 146 drilled completely through the valve member 138, transversely to the axis of rotation thereof, opens the first opening 132 to the second opening 134. A second passageway or hole 148, drilled only to the center of the valve member 138, transversely to the axis of rotation thereof and ninety degrees from the first hole 146, is blocked closed against the bearing 140. A third passageway or hole 150, drilled axially to the center of the valve member 138 and into the first hole 146 opens the first opening 132 and the second opening 134 through the third opening 136. Thus in the position of FIG. 8, the valve member 138 permits the metering tank 84 and the dispensing spout 64 (which is then disposed in the position shown in FIG. 2) to be filled from the reservoir tank 78.

When pivoted ninety degrees to the position shown in FIG. 9, the valve member 138 has the first hole 146 blocked closed against the bearing 140 and has the second hole 148 open to the second opening 134. The valve member 138 thus permits the contents of the metering tank 84 to be emptied through the third hole 150, the fitting 139, and the block 141 into the plastic tube 210 of the dispensing spout 64.

It has been found that when the plastic tube 210 has a relatively small cross-sectional, inner diameter, i.e. a diameter of one-quarter of an inch or less and preferably of approximately three-sixteenths of an inch, the cleaning solution in the metering tank 84 flows onto the mop 56 at a rate found to be compatible with substantially complete absorption by the mop 56 and with rapid speed e.g. about forty-five seconds. This is due to the syphoning effect of the small diameter of the tube 21. It has also been found that when the inner diameter of the tube 21 is greater than approximately one-quarter of an inch, the time required to empty the tank 84 becomes too long for efficient work. To spread the cleaning solution onto the mop 56, the free end 68 of the dispensing spout 64 and the plastic tube 210 are spread and flattened. Additionally, when the spout 64 is in its non-dispensing position, as shown in FIG. 2, it is spatially removed from the vicinity of the mop bucket 26 so as not to impede the removal, return or wringing out of the mop 56.

Figure 10:
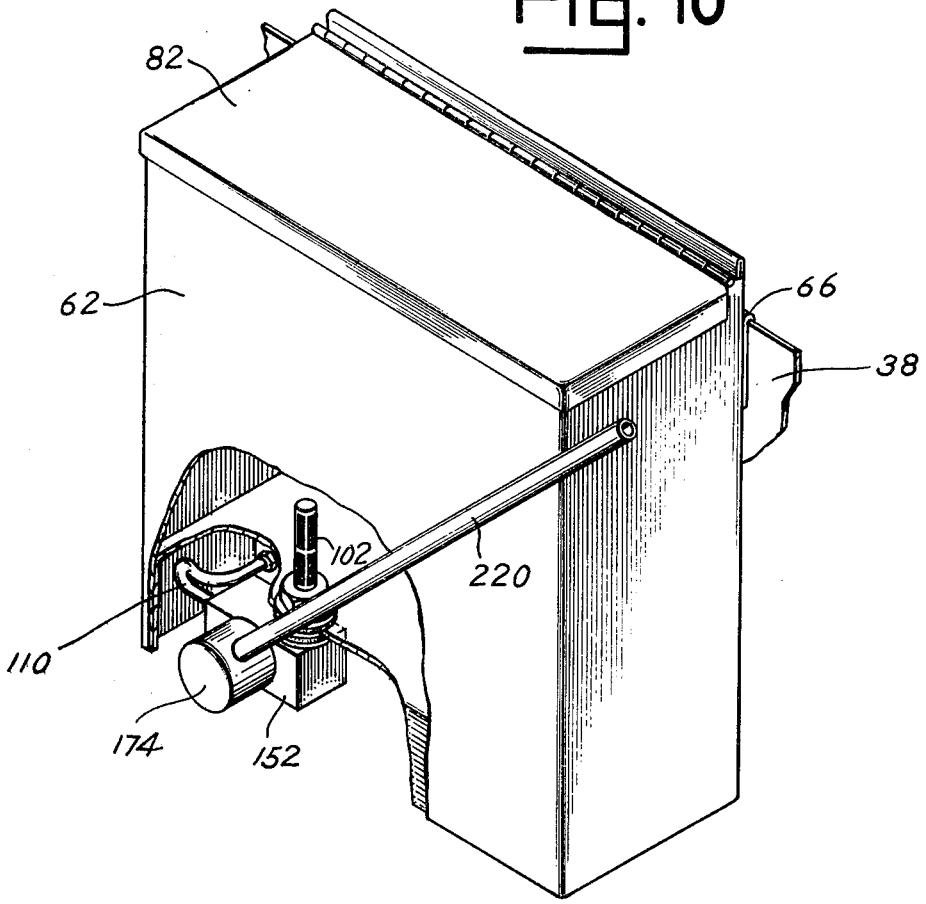
FIG. 10 is a perspective view of a reservior tank, similar to FIG. 4, depicting the preferred embodiment of the invention.
Figure 11:
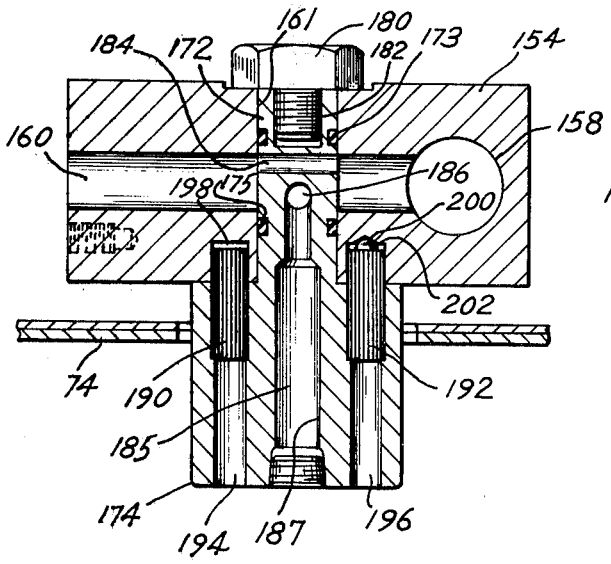
FIG. 11 is a cross-sectional view similar to FIG. 8 of the valve in the preferred embodiment.
Figure 12:
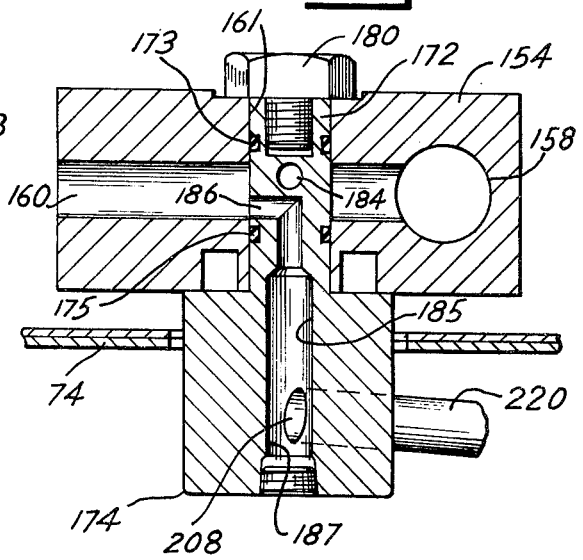
FIG. 12 is a cross-sectional view similar to FIG. 9 of the valve in the preferred embodiment.

A preferred embodiment of the dispensing unit 22 of the present invention is shown in FIGS. 10–12 and is structurally and functionally identical to the unit 22 shown in FIGS. 1–9 except for a second alternative valve 152 and a second alternative spout 220. The valve 152 is shown in the filling mode in FIG. 11 and in the dispensing mode in FIG. 12. The valve 152 is the preferred valve of the two valves 86 and 152, because among other reasons, the valve 152 does not permit the dispensing spout 220 to be filled in the filling mode, as is the valve 86. Thus "fresh" cleaning solution cannot be spilled from the dispensing spout 220 as it is pivoted to the dispensing position.

As shown in FIG. 11, the valve 152 includes a valve body 154 that is rectangular in cross-section. An L-shaped passageway having two portions 158 and 160 is drilled through the valve body 154. The portion 158 has an axis perpendicular to the plane of an upper surface of the valve body 154, and forms a "first port". The portion 160 has an axis parallel to the plane of the upper surface and defines a "second port".

As with the valve 86, the valve 152 is connected to the reservoir tank 78 and the metering tank 84. That is, the portion 160 of the L-shaped passageway in the valve body 154 is adapted to receive a fitting (not shown) by which a pipe or tube 110 connects the portion 160 to the metering tank 84. Unlike the valve body 116, however, the valve body 154 is constructed and arranged so that portion 160 connects directly to the fluid filter 102.

Drilled transversely to and through the passageway portion 160 is a cylindrical hole 161 in which a cylindrical extension 172 of the valve member 174 is pivotally or rotatably mounted on the valve body 154. A machine bolt 180 is screwed into a threaded recess 182 in the distal end of the extension 172 so that its head abuts against the valve body 154 so as to secure the extension 172 in position as shown in FIGS. 11 and 12. Two O-rings 173 and 175 mounted in circumferential grooves cut along the extension 172 seal opposite sides of the portion 160 when the valve member 174 is mounted in the valve body 154.

The valve member 174 is pivotable or rotatable through a ninety degree arc about its longitudinal axis between the positions shown in FIGS. 11 and 12. Two pins 190 and 192 fitted in axially extending recesses 194 and 196 in the valve member 174 co-operate with ninety-degree arcuate slots 198 and 200, shown in cross-section in FIGS. 11 and 12, in the valve body 154 to define and limit the path of movement of the valve member 174. The pin 192 also co-operates with a ball 202, a coil compression spring (not shown) and recesses in the slot 200 to define detent means for holding the valve member 174 in its fluid dispensing position or its fluid non-dispensing position.

In the position of FIG. 11, a first passageway portion 184 is drilled transversely through the extension 172 and opens the passageway portion 160 to the passageway portion 158. A second L-shaped passageway 185 is drilled in the valve member 174 and includes a first, transverse portion 186 that forms a third port and a second longitudinal portion 187 that extends along the longitudinal axis of the member 174. This third port is blocked against the valve body 154 when the member 174 is positioned as shown in FIG. 11. Thus in the position of FIG. 11, the valve member 174 permits the metering tank 84 to be filled from the reservoir tank 78 while preventing the dispensing spout 220 from being filled.

When pivoted ninety-degrees to the position shown in FIG. 12, the valve member 174 has the first passageway 184 blocked at both ends thereof against the valve body 154 and the second passageway 185 is open to the passageway portion 160. As shown in FIG. 12, the second passageway portion 187 communicates with the passageway 208 into which the end of the hollow dispensing spout 220 is screwed. The inner diameter of the dispensing spout 220 is about three-sixteenths of an inch, and thus the dispensing spout 220 functions, as does the dispensing spout 64, to permit the relatively rapid, smooth flow of "fresh" cleaning solution onto the mop 56.

The dispensing unit 22 can be further modified by eliminating the bottom 72 and by placing a molded plastic container or liner within the walls 74–77. This container then serves as a reservoir tank, like the tank 78, and its usage, in place of the tank 78, reduces the cost of manufacturing the unit 22. A hole is formed in the bottom of this container to receive the filter 102 and the container functions, in all respects, like the tank 78.

The present invention also includes a novel method for rinsing and sanitizing the mop 56. This method includes the steps of: placing the mop 56 in the bucket 26 to rinse away any large particles of dirt and the like that might be on the mop 56 as a result of using the mop to clean a surface. The mop 56 is then placed in the mop wringer 52 and any "dirty" or contaminated solution is wrung out of the mop 56 and into the mop bucket 26 through the use of the wringer 52. The spout 64 or 220 is then moved to its dispensing position so that a pre-selected volume of "fresh" cleaning solution from the dispensing unit 22 will be dispensed onto the mop 56. A portion of this "fresh" solution is then wrung from the mop 56 by use of the wringer 52 so that the mop 56 is partially dry and ready for further cleaning.

Alternatively, the mop 56 need not be initially placed in the bucket 26, but rather can be placed directly in the wringer 52. In this alternative, a first pre-selected volume of "fresh" solution is dispensed onto the mop 56 by moving the spout 64 or 220 to its dispensing position, and the spout is returned to its non-dispensing position. The mop 56 is then wrung dry and a second pre-selected volume of "fresh" solution is dispensed onto the mop 56 by again moving the spout 64 or 220 to its dispensing position. The mop 56 is then wrung partially dry so that a portion of the "fresh" solution is retained in the mop. The mop 56 is again ready to be utilized to clean a new surface.

From the foregoing, it should be apparent to those having skill in the art that modifications or changes could be made in the design of the mop rinsing apparatus described herein. Thus the preferred embodiment of the present invention is to be considered in all respects as illustrative and not restrictive, the scope of the invention claimed being measured by the appended claims, rather than the foregoing description. All changes which come within the meaning and range of equivalency of the claims are therefore intended to be embraced therein.

What is claimed is:

1. An improved apparatus for rinsing and sanitizing a mop by dispensing a pre-selected volume of "fresh" cleaning solution onto the mop and adapted to be utilized with a conventional mop bucket having a capacity of multiple pre-selected volumes of cleaning solution and having a conventional mop wringer mounted on the upper, open end of the bucket so as to maintain a mop therein out of contact with any cleaning solution in the bucket as a result of normal usage of the apparatus, bucket and mop, said apparatus comprising, in combination:

a reservoir tank defining a reservoir to hold multiple pre-selected volumes of "fresh" cleaning solution;

a metering tank defining a metering chamber to hold a single pre-selected volume of "fresh" cleaning solution;

a dispensing spout for dispensing "fresh" cleaning solution onto the mop when the mop is disposed in the mop wringer; and valve means for selectively connecting the reservoir in the reservoir tank with the metering chamber in the metering tank so that the metering chamber is filled with "fresh" cleaning solution from the reservoir and for selectively connecting the metering chamber in the metering tank with the dispensing spout so that the pre-selective volume of "fresh" cleaning solution in the metering chamber empties through the dispensing spout onto the mop in the mop wringer.

2. The improved apparatus as claimed in claim 1 wherein the valve means defines a first port, a second port and a third port; wherein the reservoir in the reservoir tank is connected to the first port; wherein the metering chamber in the metering tank is connected to the second port; wherein the dispensing spout is connected to the third port; wherein the valve means has a filling mode and a dispensing mode and being operable for connecting said first port to said second port in said filling mode so that said metering chamber fills with cleaning solution from said reservoir and for connecting said second port to said third port and disconnecting said second port from said first port in said dispensing mode, so that said metering chamber empties of said cleaning solution through said dispensing spout onto said mop.

3. The improved apparatus as claimed in claim 2 wherein said valve means is operable for disconnecting said third port from both said first port and said second port in said filling mode so that said dispensing spout does not fill with cleaning solution until said third port is connected with said second port in said dispensing mode.

4. The improved apparatus as claimed in claim 2 wherein said dispensing spout is movable between a dispensing position and a non-dispensing position; and wherein the dispensing spout includes means for moving the valve means so that movement of the dispensing spout between its dispensing position and a non-dispensing position results in the valve means being moved between its dispensing mode and its filling mode.

5. The improved apparatus as claimed in claim 2 wherein said valve means includes a valve body rotatable approximately ninety degrees about an axis between a first rotational position which defines said filling mode and a second rotational position which defines said dispensing mode, said valve body having a first passageway, a second passageway and a third passageway defined therein, said first passageway lying transversely of said axis and joining said first port and said second port in said filling position, said second passageway lying transversely of said axis and of said first passageway and joining said second port to said third port in said dispensing mode and said third passageway lying parallel to said axis and joining said third port to said first port in both said filling mode and said dispensing mode; and wherein the apparatus includes means for rotating the valve body.

6. The improved apparatus as claimed in claim 2 wherein said valve means includes a valve body rotatable approximately ninety degrees about an axis between a first rotational position which defines said filling mode and a second rotational position which defines said dispensing mode, said valve body having a first passageway and a second passageway defined therein, said first passageway lying transversely of said axis and joining said first port and said second port in said filling mode, and said second passageway being L-shaped and having a first section lying transversely of said axis and a second section lying parallel to said axis, said second passageway in said dispensing mode joining said second port and said third port; and wherein the apparatus includes means for rotating the valve body.

7. The improved apparatus as claimed in claim 1 wherein said metering tank is mounted below said reservoir tank so that gravity causes the cleaning solution in said reservoir to fill said metering chamber.

8. The improved apparatus as claimed in claim 1 further comprising means for venting said metering chamber so that the filling thereof is not resisted by trapped air.

9. An improved method for rinsing and sanitizing a mop with a pre-selected volume of "fresh" cleaning solution, the mop being used to clean surfaces in cooperation with a conventional mop bucket having a capacity of multiple pre-selected volumes of cleaning solution and having a conventional mop wringer mounted on the upper, open end of the bucket so as to maintain a mop therein out of contact with any cleaning solution in the bucket as a result of normal usage, said method comprising the steps of:

(1) placing the mop in the mop wringer;
(2) wringing any "dirty" cleaning solution from the mop into the mop bucket by actuation of the mop wringer;
(3) dispensing a pre-selected volume of "fresh" cleaning solution onto the mop; and
(4) wringing a portion of said "fresh" cleaning solution into the mop bucket by again actuating the mop wringer so that the mop is partially dry for use in cleaning a surface.

10. The improved method as claimed in claim 9 which includes the step of placing the mop into the cleaning solution in the mop bucket, prior to placing the mop in the mop wringer, to remove dirt particles and the like from the mop.

11. The improved method as claimed in claim 9 which includes the additional steps of wringing the mop "dry" by actuating the mop wringer after the pre-selected volume of "fresh" cleaning solution has been dispensed on the mop, and then dispensing another pre-selected volume of "fresh" cleaning solution onto the mop prior to performing the step of wringing a portion of the "fresh" cleaning solution from the mop into the mop bucket.

* * * * *